United States Patent [19]

Akiyama et al.

[11] 4,132,507

[45] Jan. 2, 1979

[54] BLOWING APPARATUS

[75] Inventors: Satoshi Akiyama; Michio Shikutani, both of Odawara, Japan

[73] Assignee: Kabushiki Kaisha Shikutani, Odawara, Japan

[21] Appl. No.: 854,211

[22] Filed: Nov. 23, 1977

[30] Foreign Application Priority Data

Jul. 13, 1977 [JP] Japan ..... 52-083013

[51] Int. Cl.[2] ..... F04B 21/00; F04B 17/00

[52] U.S. Cl. ..... 417/234; 417/364

[58] Field of Search ..... 417/234, 364; 239/136, 239/137, 129; 415/219 R

[56] References Cited

U.S. PATENT DOCUMENTS

| | | | |
|---|---|---|---|
| 1,801,964 | 4/1931 | Kuendig | 417/234 |
| 2,884,075 | 4/1959 | Poon | 417/234 |
| 3,135,214 | 6/1964 | Johnson | 417/364 |
| 3,775,023 | 11/1973 | Davis et al. | 415/219 R |

FOREIGN PATENT DOCUMENTS

| | | | |
|---|---|---|---|
| 664011 | 1/1952 | United Kingdom | 415/219 R |

*Primary Examiner*—John J. Vrablik
*Assistant Examiner*—R. E. Gluck
*Attorney, Agent, or Firm*—Birch, Stewart, Kolasch & Birch

[57] ABSTRACT

Blowing apparatus suspensible from one's shoulder is provided with an axial blower having the rotor thereof coupled with the crankshaft of a gasoline engine. The stator blades of the blower are removably fixed peripherally to the housing of blower and partially to the casing of the engine. The engine does not require a cooling fan because it is sufficiently cooled by the suction-air flowing around. Further an independent fuel tank is not required because of a hollow guide disposed in front of the rotor and serving as a fuel storage. The nozzle, flexible tube, and the discharge housing of the blower can be made of synthetic plastics in the form of a single annular body without any connecting means. Consequently, the apparatus of the present invention is remarkably light and compact.

7 Claims, 6 Drawing Figures

BLOWING APPARATUS

BACKGROUND AND SUMMARY OF THE INVENTION

The present invention relates to blowing apparatus of the type having an axial fan driven by a gasoline engine and more particularly to a tubular body suspensible from one's shoulder both for use and for conveyance.

Power blowers are known that are provided with a centrifugal fan and carried on one's back. Such blowers are usually equipped with an unexchangeable one-sided, generally right-handed blowing nozzle and therefore are awkward to do tasks on the left. It is often the case that a blowing operation accompanies another work, such as water-sprinkling, repairing gutters and downspouts, and carrying garbage cans, it is troublesome to load and unload the blower on and from operator's back whenever the type of work changes.

In accordance with the present invention, the apparatus has interiorly a gasoline engine and an axial fan and exteriorly an annular body, a flexible tube, and a blowing nozzle. The body consists of fan, suction, and discharge housings, the fan housing being removably, peripherally and air-tightly connected in front and in rear with the suction and discharge housings, respectively. The suction housing surrounds the engine which has the crankshaft coupled with the rotor of the fan and the casing detachably fixed to the stator blades of the fan. The stator blades are removably secured to the inner periphery of the fan housing. The one or two-staged fan requires less power from the engine as compared with the conventional centrifugal fan. The engine has no cooling impellers because it is cooled by the suction-air flowing around it. There is a cone-guide coaxially disposed within the discharge housing and in front of the rotor of the fan.

In a preferred embodiment, the apparatus can be suspended from an operator's shoulder in a substantially horizontal position by a shoulder belt. Spongy pads are affixed on the both sides of the body so as to prevent uncomfortable vibrations from being transmitted to the operator. A stand is mounted on the underside of the body near a point projected by the center of gravity of the engine and occasionally wheeled for convenience instead of dragging the apparatus.

In other embodiments, the cone-guide has the inside space used as a fuel tank, in order to make the apparatus light and compact. The blowing nozzle and flexible tube or the discharge housing in addition to them are made of synthetic plastics in the form of a single body without any connecting means, for the purpose of reducing the weight of the apparatus.

In summary, it is an object of the present invention to provide a blowing apparatus of the type having an axial blower.

Another object of the invention to provide a blowing apparatus suspensible from one's shoulder.

A further object of the invention to provide a blowing apparatus that is light and compact.

Other objects and further scope of applicability of the present invention will become apparent from the detailed discription given hereinafter; it should be understood, however, that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
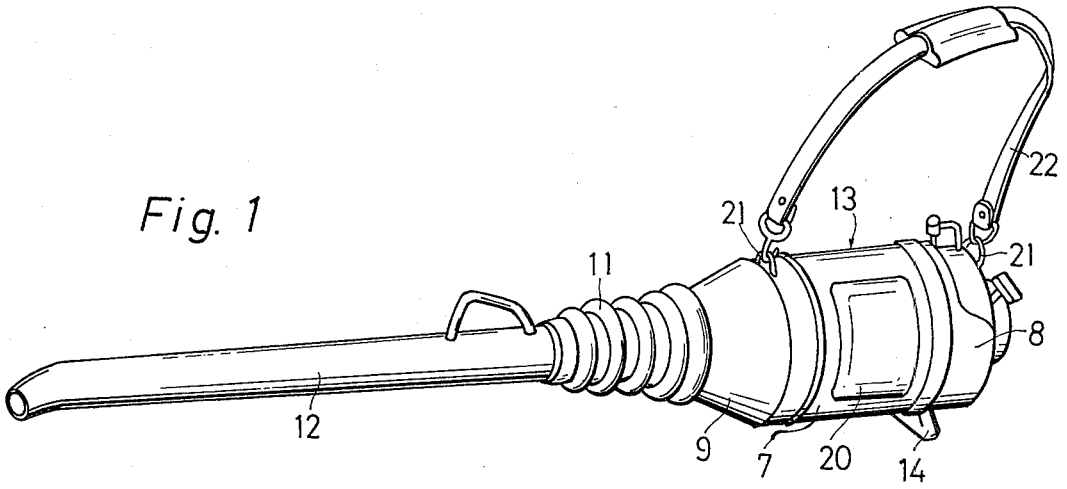
FIG. 1 is a perspective view of an embodiment of the apparatus according to the present invention.
Figure 2:
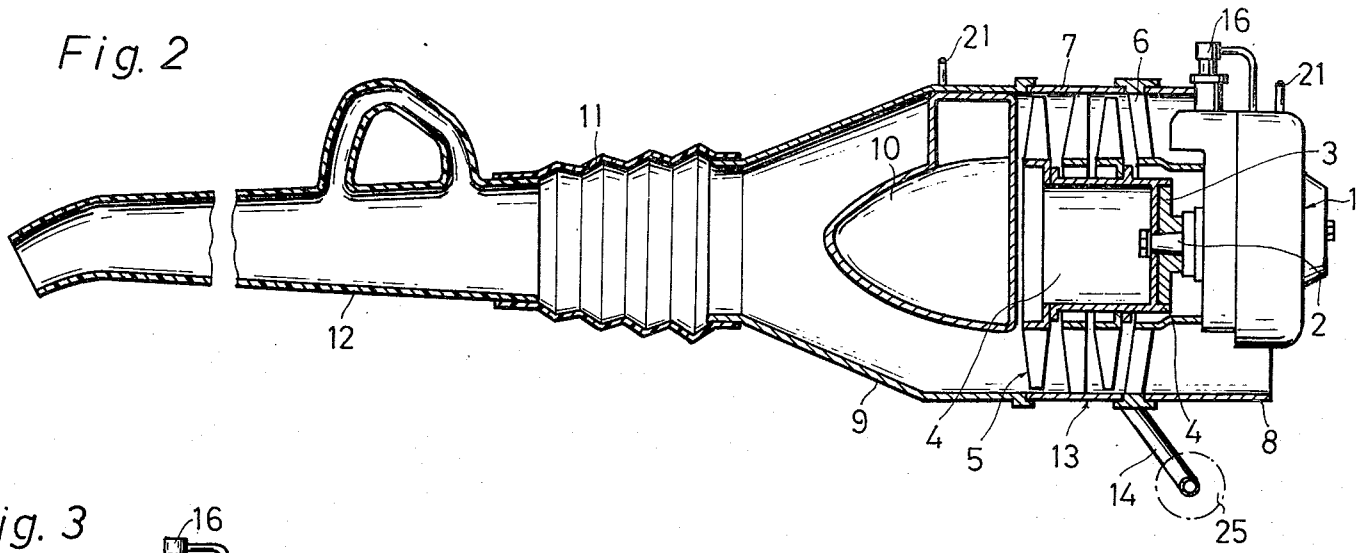
FIG. 2 is a longitudinal sectional view of the apparatus of FIG. 1.
Figure 3:
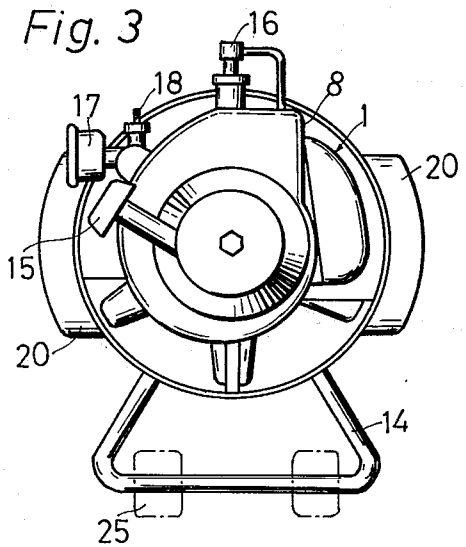
FIG. 3 is a rear elevational view of the apparatus of FIG. 1.

Referring to FIGS. 1–3, the portable type blower of the present invention includes in appearance a handled nozzle 12, a flexible tube 11, and an annular body 13, and a shoulder belt 22. The body 13 is composed of a fan, suction, and discharge housings 7, 8 and 9, the suction and discharge housings 8 and 9 being peripherally, air-tightly and removably coupled with the front and rear of the fan housing 7, respectively. The belt hooks 21 are fixed to the top of the body 13 in a manner that the belt 22 hangs the blower in a substantially horizontal position. The pads 20 made of spongy material are mounted on the opposite sides of the body 13 or the fan housing 7.

The suction housing 8 surrounds a gasoline engine 1 except for a few parts such as a starter 15, an ignition plug 16, an air-cleaner 17 and a throttle valve 18. The engine 1 has the crankshaft 2 screwed to a flange 3 to which is screwed the rotor 4 of a two-staged axial fan 5. The axial fan 5 has the two-staged stator-blades 6 secured to the inner periphery of the fan housing 7. The casing of the engine 1 is screwed to the first stage of the stator-blades 6 so as to make one body together with the fan housing 7 or the annular body 13. A cone-guide 10 is partially radially fixed to the inner periphery of the discharge housing 9 and coaxially disposed in front of the rotor 4 of the fan 5.

The blowing nozzle 12 is removably coupled with the forward end of the flexible tube 11 which is detachably connected to the front end of the discharge housing 9. A stand 14 mounted on the underside of the body 13 grounds near a point projected by the center of gravity of the engine 1 so as to be stably trailed. Sometimes, the blower can be dragged during use as well as during conveyance by the use of wheels 25 attached to the stand 14 as shown by dotted lines in FIGS. 2 and 3.

Figure 4:
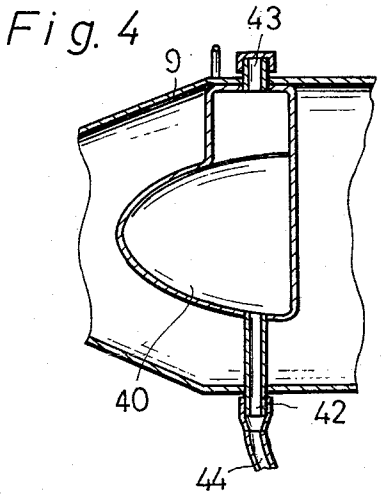
FIG. 4 is a partial sectional view of another embodiment.

Referring now to FIG. 4, there is shown another embodiment having no independent fuel tank but the cone-guide 40 serving as a fuel tank. The cone-guide 40 has its inside space employed for fuel storage and equipped with inlet and outlet ports 43 and 42 on the top and bottom and a fuel pipe 44 extending toward the engine. This embodiment becomes light and compact because the weight of an independent fuel tank is not required.

Figure 5:
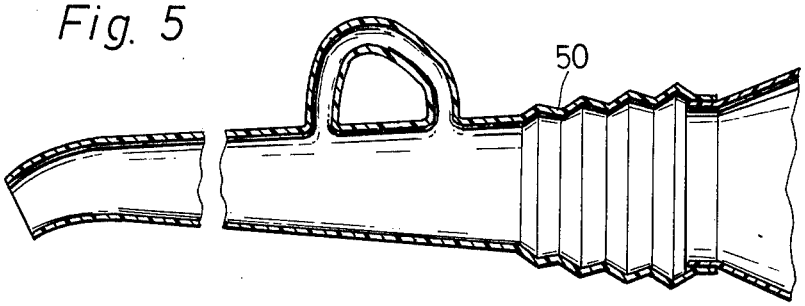
FIGS. 5 and 6 are sectional views of the blowing portion of different embodiments.
Figure 6:
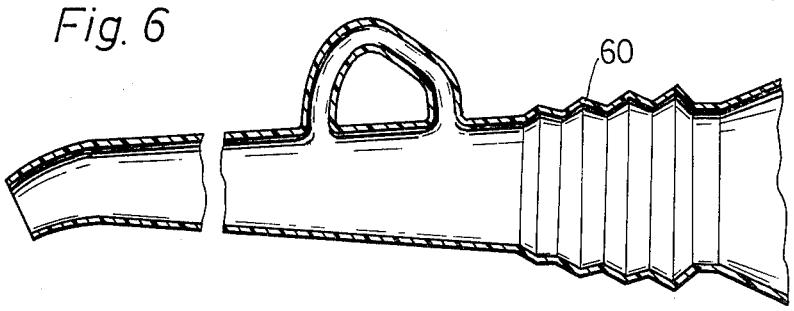

Referring to FIGS. 5 and 6, the blowing part composed of the blowing nozzle and flexible tube or the discharge housing of the body 13 in addition to them can be made of synthetic plastics in the form of a single tubular body 50 or 60, by means of a blow-molding method. It will be understood that these embodiments will be simple in construction and able to make the blower less heavy.

The manner of operation of the blower described in connection with the drawings will now be explained. The inventive blower is always equipped with a relatively small engine. One reason for this is that an axial blower requires an engine less power for the same volumetric air-flow than a centrifugal blower. In addition, the engine 1 requires no cooling fan due to being cooled by the suction-air flowing around it. The blower is light and compact, for example it weighs less than 7 Kg. and has a diameter of about 200 mm. An operator can easily position and disengage the blower from either his right and left shoulder in accordance with working condition. The operator can remove the blower from his shoulder and set it aside with litte effort whenever he desires to use another tool for doing different tasks such as repairing gutters and downspouts and water-sprinkling.

Upon actuation of the engine 1, the blower generates a jet of air at speeds of up to 50 m/sec enough for cleaning away dead leaves, greens and debris from street and gardens as well as for blasting off accumulated soil and shingles from roofs. The operator can firmly hold the body 13 of the blower with the pad 20 against his body and freely operate the handled nozzle 12 with his hand to perform blowing works. The spongy pad 20 absorbs uncomfortable vibrations to prevent its transmission to the operator. In the case of the blower provided with wheeled stand 14, it will be dragged to roll both for use and for conveyance.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A blowing apparatus comprising a gasoline engine, an axial fan having the rotor thereof coupled with a rotating shaft of said engine, an annular body composed of fan, suction and discharge housings, a flexible tube connected to the front end of the discharge housing, a blowing nozzle connected to the forward end of said flexible tube, a shoulder belt attached to said annular body, said axial fan having the stator blades thereof removably secured to the inner periphery of the fan housing, said engine having a casing thereof detachably fixed to the stator blades, the suction housing surrounding said engine, a cone-guide coaxially disposed in front of the rotor and partially radially secured to the inner periphery of the discharge housing, the fan housing being removably, air-tightly and peripherally connected to both the suction and discharge housings.

2. A blowing apparatus according to claim 1, wherein said cone-guide has the inside space formed as a fuel tank and inlet and outlet ports mounted therein.

3. A blowing apparatus according to claim 1, wherein said blowing nozzle and flexible tube are made of synthetic plastics in the form of a single tubular body without connecting means.

4. A blowing apparatus according to claim 3, wherein the discharge housing of said body is made of synthetic plastics in the form of a single body together with said blowing nozzle and flexible tube without connecting means.

5. A blowing apparatus according to claim 1, wherein said annular body has a pair of pads of spongy material mounted on the both sides thereof.

6. A blowing apparatus according to claim 1, wherein said annular body has a stand mounted on the underside thereof, said stand grounding near a point projected by the center of gravity of said engine.

7. A blowing apparatus according to claim 6, wherein said stand is wheeled.

* * * * *